US007546071B2

(12) United States Patent
Inoue et al.

(10) Patent No.: US 7,546,071 B2
(45) Date of Patent: Jun. 9, 2009

(54) DEVELOPING DEVICE FOR PREVENTION OF COAGULATE TONER ADHERENCE AND IMAGE FORMING APPARATUS USING THE DEVELOPING DEVICE

(75) Inventors: Atsushi Inoue, Nara (JP); Yuichi Kazaki, Kashiba (JP); Takayuki Yamanaka, Nara (JP); Hiroaki Nakaya, Osakasayama (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 11/712,519

(22) Filed: Mar. 1, 2007

(65) Prior Publication Data

US 2007/0206977 A1 Sep. 6, 2007

(30) Foreign Application Priority Data

Mar. 3, 2006 (JP) ..... P2006-058243

(51) Int. Cl.
*G03G 15/08* (2006.01)

(52) U.S. Cl. ..... 399/284; 399/43; 399/71; 399/98

(58) Field of Classification Search ..... 399/284, 399/274, 71, 98, 99, 43
See application file for complete search history.

(56) References Cited

U.S. PATENT DOCUMENTS 4,373,798 A * 2/1983 Tsukada et al. ..... 399/267
2001/0005458 A1 6/2001 Yamanaka et al. ..... 399/43
2002/0085862 A1* 7/2002 Woerkens ..... 399/284 X
2005/0220499 A1 10/2005 Kawahara et al. ..... 399/281
2006/0210321 A1* 9/2006 Nakasone et al. ..... 399/284

FOREIGN PATENT DOCUMENTS

| | | | |
|---|---|---|---|
| CN | 1670633 A | | 9/2005 |
| JP | 58-150984 A | | 9/1983 |
| JP | 62-86381 A | | 4/1987 |
| JP | 8-254895 A | | 10/1996 |
| JP | 2001-175078 A | * | 6/2001 |
| JP | 2001-194896 A | | 7/2001 |
| JP | 2001-249538 A | | 9/2001 |
| JP | 2003-208015 A | | 7/2003 |

* cited by examiner

*Primary Examiner*—Sophia S Chen
(74) *Attorney, Agent, or Firm*—Nixon & Vanderhye, P.C.

(57) ABSTRACT

A developing device includes a developer tank, a developing roller, a supply roller, a stirring member, and a doctor blade. The developing device is provided with: a cleaning member detachably provided on a contact portion of the doctor blade with the developing roller, which slides to rub a surface of the doctor blade upon contacting; a supporting section for supporting the cleaning member so as to be capable of being attached to and detached from the contact portion of the doctor blade with the developing roller; and a driving mechanism for moving the cleaning member so as to be attached to and detached from the contact portion of the doctor blade with the developing roller.

19 Claims, 7 Drawing Sheets

DEVELOPING DEVICE FOR PREVENTION OF COAGULATE TONER ADHERENCE AND IMAGE FORMING APPARATUS USING THE DEVELOPING DEVICE

CROSS-REFERENCE TO RELATED APPLICATION

This application claims priority to Japanese Patent Application No. JP 2006-58243, which was filed on Mar. 3, 2006, the contents of which, are incorporated herein by reference, in their entirety.

BACKGROUND

1. Field

The present disclosure relates to a developing device and an image forming apparatus.

2. Description of the Related Art

An electrophotographic system, which enables easy formation of high-quality images at relatively low-cost, has been widely adopted into image forming apparatuses such as a copier, a printer, and a facsimile. An electrophotographic image forming apparatus comprises: for example, a photoreceptor drum of which surface is provided with a photosensitive layer containing a photoconductive substance; a charging section for charging the surface of photoreceptor drum; an exposing section for exposing the surface of photoreceptor drum being charged, to form thereon an electrostatic latent image; a developing section for supplying a toner to the electrostatic latent image formed on the surface of photoreceptor drum, to form thereon a toner image; a transfer section for transferring to a recording medium, etc. the toner image carried on the surface of photoreceptor drum; and a fixing section for fixing the toner image existing on the recording medium by subjecting the toner image to heating, pressing, and the like operation. In the electrophotographic image forming apparatus as described above, a non-magnetic one-component developing device is generally used as the developing section in view of facilitation of maintenance, reduction in size and weight of the image forming apparatus itself, and thus of cost reduction. A commonly-used non-magnetic one-component developing device is composed of a developer tank, a developing roller, a supply roller, a stirring member, and a doctor blade. The developer tank accumulates a toner therein, and supports the developing roller, the supply roller, and the stirring member so as to be rotatable. The developing roller is disposed in pressure-contact with the photoreceptor drum, and has its surface carrying a toner layer. The supply roller is disposed in pressure-contact with the developing roller, and supplies a toner to a surrounding area of the developing roller. The stirring member stirs a toner accumulated in the developer tank. The doctor blade is disposed in contact with the surface of developing roller to regulate a layer thickness of the toner layer on the surface of developing surface. The non-magnetic one-component developing device serves to form a toner image by supplying a toner from the toner layer on the surface of developing roller to an electrostatic latent image on the photoreceptor drum.

The non-magnetic one-component developing device has a problem that a toner is more easily coagulated compared to the case of using a two-component developer containing a toner and a magnetic carrier. Especially in a contact portion between the developing roller and the doctor blade, the toner coagulation causes a serious problem. Since the doctor blade comes into contact with the surface of developing roller under pressure in order to regulate the layer thickness of the toner layer on the surface of developing roller, there is given relatively high pressure and frictional heat between the developing roller and the doctor blade. The toner coagulation resulting in generation of a toner mass at the contact portion leads decrease in flowability of the toner, in a consequence whereof the toner mass remains on the portion and is subjected to higher pressure and frictional heat which cause the toner mass to be fused and then adhered to the contact portion of the doctor blade with the developing roller. The fused toner adhered to the doctor blade scrapes the toner layer on the developing roller, which contacts the toner-adhered part, thus causing an image defect such as white stripes. Moreover, the pressure imparted to the toner-adhered part becomes higher, thus setting a condition on which the fusion and adhesion of toner is promoted more easily. Accordingly, the toner-adhered part grows in size over time and thereby gives flaws to the surface of developing roller, with the result that a service life of the apparatus itself may possibly be shortened.

Denaturing a surface property of the doctor blade in order to prevent the toner from being fused and adhered to the doctor blade has been proposed. For example, attentions are paid to the aspect that the toner is fused and adhered not to a contact portion of the doctor blade but a non-contact portion thereof with the developing roller. From the aspect, there has been proposed to apply synthetic resin having low-surface energy, such as silicone resin and fluorine resin, to the non-contact portion of the doctor blade with the developing roller (refer to Japanese Unexamined Patent Publication JP-A 62-86381 (1987), for example). Another proposal is to form on at least a surface of the contact portion of the doctor blade with the developing roller a nickel-phosphorus composite plated layer containing fluorine resin dispersed therein (refer to Japanese Unexamined Patent Publication JP-A 2001-194896, for example). The techniques disclosed in JP-A 62-86381 (1987) and JP-A 2001-194896 cannot, however, sufficiently prevent the toner from undergoing the fusion and adhesion because an image forming apparatuses of date uses a toner having a relatively low melting point. In addition, as stated in JP-A 62-86381 (1987), it is well known that the toner is not frequently fused and adhered to the contact portion but fusion and adhesion of the toner to the non-contact portion more frequently occurs.

Further, there has been a proposal of disposing a platy doctor blade such that one end in a transverse direction thereof is supported by a developer tank and the other end thereof is brought into contact with or spaced a distance away from a surface in a vertical direction of a developing roller, wherein the transverse direction extends in the vertical direction, and further providing a pressing member which slides in the vertical direction to rub a surface of the doctor blade positioned at upstream side of a rotation direction of the developing roller (refer to Japanese Unexamined Patent Publication JP-A 58-150984 (1983), for example). However, the fusion and adhesion of toner easily occur also on a surface of the doctor blade positioned at downstream side of the rotation direction of the developing roller, and actually in many cases, the fusion and adhesion of toner occurring on the downstream surface is massive. Accordingly, the fused and adhered toner cannot sufficiently removed by the pressing member. Another problem of JP-A 58-150984 (1983) is risk that the pressing member sliding in parallel with the surface of the doctor blade might cause the toner to be caught between the pressing member and the rubbing surface of the doctor blade, resulting in the toner adhesion over an entire surface of the doctor blade. Moreover, in JP-A 58-150984 (1983), it is stated that the pressing member is made to move up and down in the vertical direction to thereby rub the surface of the doctor blade. However, JP-A 58-150984 (1983) contains no disclosure about a mechanism of moving the pressing member up and down. It is thus very difficult to realize the invention described in JP-A 58-150984 (1983).

SUMMARY

In an aspect of the disclosed technology, a developing device is provided in which a toner is prevented from being fused and adhered to a doctor blade irrespective of a type of the toner even having a low melting point, and which is thus capable of forming images of high quality having no image defects such as white stripes, for a long period of time, as well as an electrophotographic image forming apparatus provided with the developing device.

An embodiment of a developing device provided in an electrophotographic image forming apparatus comprises:

a developer tank having an internal space for containing a toner;

a developing roller for carrying a toner layer on a surface thereof and supplying a toner to an electrostatic latent image on a photoreceptor drum;

a doctor blade in contact with a surface of the developing roller, for regulating a layer thickness of the toner layer on the surface; and a cleaning member composed of a platy member, the cleaning member being disposed so that one end of the cleaning member extends in parallel with an axis line of the developing roller and makes angular contact with a contact portion of the doctor blade with the developing roller and its adjacent portion of the doctor blade while another end of the cleaning member is inserted into a through hole formed in a developer tank wall of the developer tank and extends to outside of the developer tank.

It is preferable that the developer tank wall is in a vertical direction of the developer tank, a through hole is formed in an upper part of the developer tank wall, and the other end of the cleaning member is inserted into the through hole and extends upwardly in the vertical direction of the developer tank.

There is provided a developing device composed of a developer tank, a developing roller, and a doctor blade, in which a cleaning member for the doctor blade is further contained. The cleaning member is composed of a platy member which is disposed so that one end of the cleaning member extends in parallel with an axis line of the developing roller and makes angular contact with a contact portion of the doctor blade with the developing roller and its adjacent portion of the doctor blade while the other end of the cleaning member is inserted into a through hole formed in a developer tank wall of the developer tank (preferably in an upper part of a developer tank wall in a vertical direction of the developer tank) and extends to outside (preferably upwardly in the vertical direction) of the developer tank. The cleaning member in the developing device of the invention makes angular contact with a part requiring the cleaning performed by the doctor blade, and is thus capable of subjecting a surface of the doctor blade to not a force such as rubbing the surface of the doctor blade in parallel therewith but a force such as intersecting with the surface of the doctor blade. As a result, even when a coagulated product of toner or the like is adhered to the doctor blade, the coagulated product can be easily removed before being fused and adhered to the doctor blade. Moreover, the coagulated product once removed is never adhered again to the other parts of the doctor blade. Consequently, the use of the developing device of the invention allows a toner to be prevented from being fused and adhered to the doctor blade irrespective of a type of the toner even having a low melting point, thus enabling formation of high-quality images having no image defects such as white stripes for a long period of time.

It is preferable that the developing device further comprises:

a supporting section having at least a part provided inside the developer tank, which supports the cleaning member so as to be detachable from the contact portion of the doctor blade with the developing roller and its adjacent portion of the doctor blade; and a driving mechanism which moves the cleaning section to be attached to and detached from the contact portion and its adjacent portion of the doctor blade.

The adoption of a configuration further comprising a supporting section which supports the cleaning member so as to be detachable from the contact portion and its adjacent portion of the doctor blade, and a driving mechanism which moves the cleaning member to be attached to and detached from the contact portion and its adjacent portion of the doctor blade causes the cleaning member to slidingly rub the doctor blade with an angle therebetween upon contacting the cleaning member and the doctor blade, resulting in expansion of area where the toner coagulated product can be removed by the cleaning member so that the toner coagulated product adhered to the doctor blade can be further effectively and reliably removed. Accordingly, an effect of preventing the toner from being fused and adhered to the doctor blade becomes higher.

It is preferable that the driving mechanism comprises:

a rotary driving section which rotates; and a drive transmitting section having one end coupled to the rotary driving section and another end coupled to the cleaning member, which converts a rotary drive caused by the rotary driving section into a reciprocal linear drive and transmits the reciprocal linear drive to the cleaning member, wherein the cleaning member is driven by the reciprocal linear drive transmitted from the drive transmitting section to be attached to and detached from the contact portion and the adjacent portion of the doctor blade.

By using a driving mechanism composed of: a rotary driving section which rotates; and a drive transmitting member having one end coupled to the rotary driving section and the other end coupled to the cleaning member, which converts a rotary movement caused by the rotary driving section into a reciprocal linear movement, the rubbing operation on the doctor blade conducted by the cleaning member becomes the reciprocal linear movement drawing a certain course, resulting in further enhancement in ability of removing the toner coagulated product. Moreover, the stressless transmission of the driving force generated by the driving mechanism to the cleaning member leads elongation in service life of the cleaning member, the supporting section, and the driving mechanism.

It is preferable that a tip of the cleaning member in contact with the doctor blade is formed into a hook shape which is bent in a rotational direction of circumference of the developing roller.

A tip of the cleaning member in contact with the doctor blade is formed into a hook shape which is bent in a direction away from the surface of the developing roller upward in the vertical direction, and the hook-shaped tip of the cleaning member thus formed moves even into the contact portion between the developing roller and the doctor blade, thereby allowing efficient removal of the toner coagulated product adhered to not only an upstream surface but also a downstream surface of the doctor blade in the rotational direction of the developing roller. This contributes to a further decrease in generation rate of image defects such as white stripes. Substantively, no white stripes are generated attributable to the adhesion of fused toner to the doctor blade.

It is preferable that at least the tip of the cleaning member in contact with the doctor blade is brush-shaped.

By virtue of the configuration such that the tip of the cleaning member in contact with the doctor blade is in form of a brush which comes into contact with the doctor blade, the toner coagulated product adhered to the doctor blade is crushed and then removed, so that the coagulated product removed from the doctor blade will never function as a seed material for recoagulation, thus allowing decrease in generation ratio of toner coagulation inside the developer tank.

It is preferable that the cleaning member is of a resin sheet.

A resin sheet which is used as the cleaning member changes its shape according to a surface profile of the doctor blade upon sliding to rub the doctor blade, thereby enhancing cleaning efficiency of the doctor blade, and moreover the resin sheet which moves into the contact portion between the developing roller and the doctor blade can contribute to effective removal of the toner coagulated products adhered to the downstream surface of the doctor blade in the rotational direction of the developing roller.

It is preferable that the resin sheet is divided into plural pieces in a longitudinal direction of the developer tank.

The cleaning member is formed of the resin sheet which is divided into plural pieces in a longitudinal direction of the developer tank to thereby disperse over an entire interior of the developer tank the toner and toner coagulated product removed from the surface of the doctor blade by the resin sheet, so that a flow of the toner inside the developer tank will be never disturbed, thus allowing the toner to be evenly charged. As a result, it is possible to achieve the extension of service life of the developing device, the formation of high-quality images for a long period of time, and the like effect.

It is preferable that the cleaning member comprises:

a first platy member which is inserted into the through hole formed in the developer tank wall and extends to outside of the developer tank; and a second platy member which extends toward the doctor blade inside the developer tank and is detachable from the doctor blade, wherein a side end portion of the first platy member extending in parallel with an axis line of the developing roller inside the developer tank is coupled to a side end portion of the second platy member which extends in parallel with the axis line of the developing roller and is located on an opposite side of a side end portion of the second platy member facing the doctor blade.

By using a cleaning member composed of: a first platy member which extends from the interior of the developer tank to outside of the developer tank; and a second platy member which extends toward the doctor blade inside the developer tank and is detachable from the doctor blade, wherein the first platy member is coupled to the second platy member, the cleaning member can move to be attached to and detached from the doctor blade by adding almost no external loads on the cleaning member, thus achieving further extension of service life of the cleaning member.

It is preferable that a tip of the doctor blade in contact with the surface of the developing roller is formed into a hook shape which is bent in an outward direction from the contact portion with the developing roller.

A tip of the doctor blade in contact with the surface of the developing roller is formed into a hook shape which is bent in an outward direction from the contact portion with the developing roller so that a smaller amount of the toner coagulated product is adhered to the doctor blade, thus achieving further extension of service life of the doctor blade and eventually developing device.

Further, an embodiment of an electrophotographic image forming apparatus is provided which comprises:

a photoreceptor drum;

a charging section;

an exposing section;

a developing section;

a transfer section; and a fixing section, wherein the developing section is any one of the developing devices described above.

The use of the above-described developing device as a developing section in an electrophotographic image forming apparatus comprising a photoreceptor drum, a charging section, an exposing section, a developing section, a transfer section, and a fixing section leads drastic reduction in wasteful consumption of the toner, thus resulting in an image forming apparatus by which high-quality images having no image defects such as white stripes can be formed for a long period of time and of which developing device only needs less-frequent facilitated maintenances.

BRIEF DESCRIPTION OF THE DRAWINGS

Other and further objects, features, and advantages will be more explicit from the following detailed description taken with reference to the drawings wherein.

DETAILED DESCRIPTION

Figure 1:
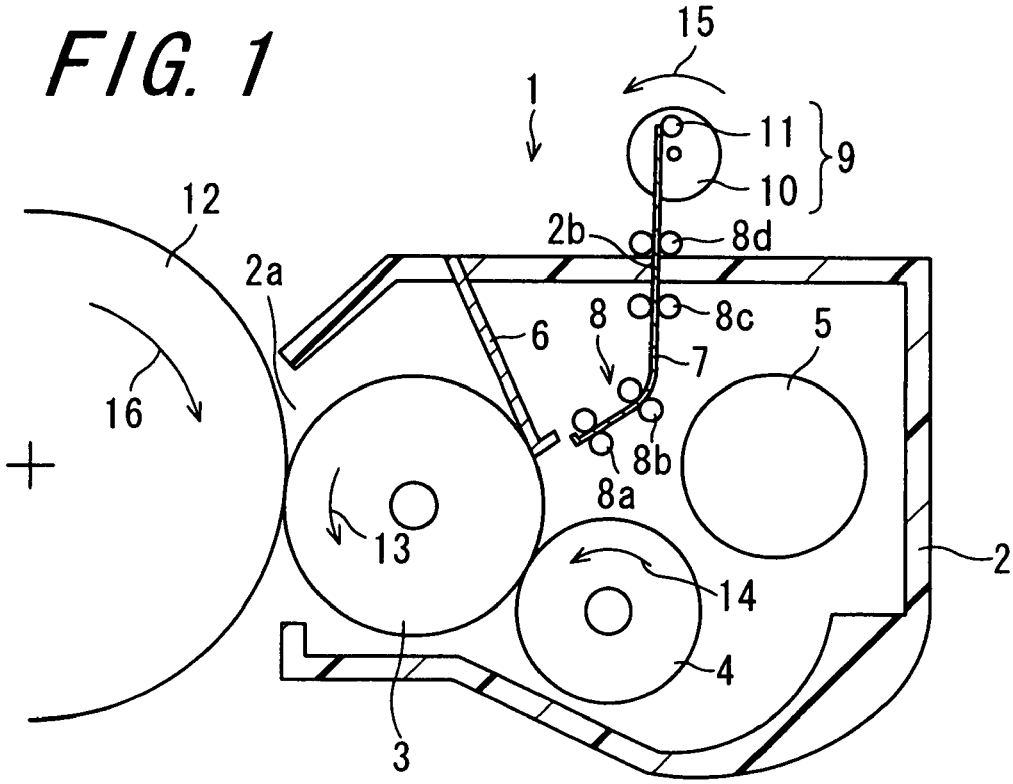
FIG. 1 is a sectional view schematically showing a configuration of a developing device according to a first embodiment.

Now referring to the drawings, preferred embodiments of the invention are described below.

Figure 2:
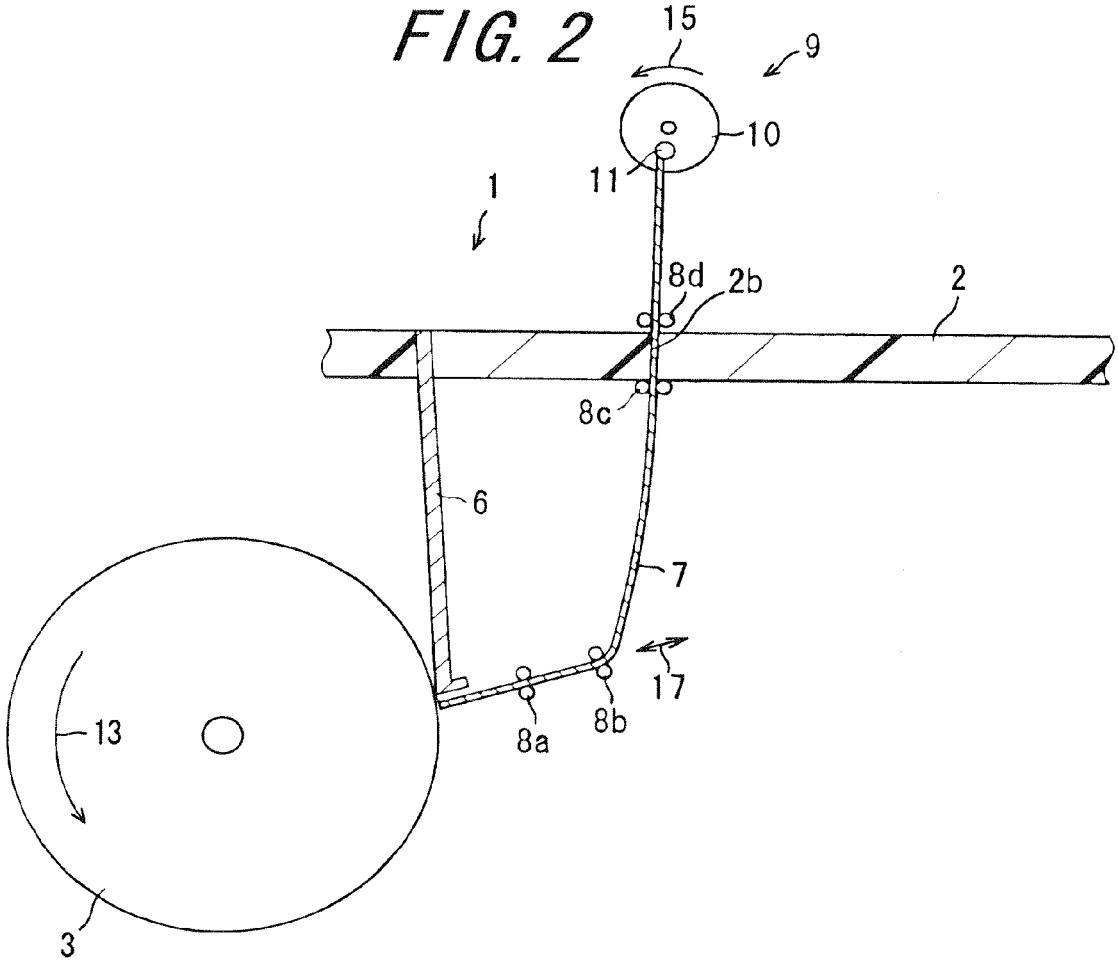
FIG. 2 is a sectional view showing the developing device shown in FIG. 1, in which a cleaning member is positioned at its contact position with a doctor blade.

FIG. 1 is a sectional view schematically showing a configuration of a developing device 1 according to a first embodiment. In FIG. 1, a cleaning member 7 is away from a doctor blade 6. FIG. 2 is a sectional view showing the developing device 1 shown in FIG. 1, in which the cleaning member 7 is in contact with the doctor blade 6. The developing device 1 is provided in an electrophotographic image forming apparatus and forms a toner image by supplying a toner to an electrostatic latent image formed on a surface of a photoreceptor drum 12, thus conducting development. The developing device 1 includes a developer tank 2 which rotates in an arrow 16 direction, a developing roller 3, a supply roller 4, a stirring member 5, the doctor blade 6, the cleaning member 7, a supporting section 8, and a driving mechanism 9.

The developer tank 2 is a container-shaped member formed of, for example, hard synthetic resin. In an interior space of the developer tank 2 are contained the developing roller 3, the supply roller 4, the stirring member 5, the doctor blade 6, the cleaning member 7, and the supporting section 8 as well as a toner. An opening 2*a* is formed in a side face of the developer tank 2 facing the photoreceptor drum 12 provided in the image forming apparatus in a state where the developing device 1 is provided in the image forming apparatus. The opening 2*a* extends in parallel with an axial direction of the photoreceptor drum 12. Moreover, a toner-receiving port (not shown) is formed in a developer tank wall located above the stirring member 5. Above the developer tank 2 when seen in a vertical direction, a toner hopper (not shown), for example, is provided. The toner hoper is connected to the developer tank 2 via a toner conveying pipe (not shown). A toner replenishing port (not shown) formed in a lower part of the toner conveying pipe communicates with the toner-receiving port of the developer tank 2, whereby the toner contained in the toner hopper is supplied to the developer tank 2 in accordance with a consumption degree of the toner therein. Further, the developer tank wall located in an upper part in the vertical direction of the developer tank 2 has a through hole 2*b* into which the later-described cleaning member 7 is inserted.

The developer tank 2 is a container-shaped member formed of, for example, hard synthetic resin. In an interior space of the developer tank 2 are contained the developing roller 3, the supply roller 4, the stirring member 5, the doctor blade 6, the cleaning member 7, and the supporting section 8 as well as a toner. An opening 2*a* is formed in a side face of the developer tank 2 facing a photoreceptor drum 12 provided in the image forming apparatus in a state where the developing device 1 is provided in the image forming apparatus. The opening 2*a* extends in parallel with an axial direction of the photoreceptor drum 12. Moreover, a toner-receiving port (not shown) is formed in a developer tank wall located above the stirring member 5. Above the developer tank 2 when seen in a vertical direction, a toner hopper (not shown), for example, is provided. The toner hoper is connected to the developer tank 2 via a toner conveying pipe (not shown). A toner replenishing port (not shown) formed in a lower part of the toner conveying pipe communicates with the toner-receiving port of the developer tank 2, whereby the toner contained in the toner hopper is supplied to the developer tank 2 in accordance with a consumption degree of the toner therein. Further, the developer tank wall located in an upper part in the vertical direction of the developer tank 2 has a through hole 2*b* into which the later-described cleaning member 7 is inserted.

The developing roller 3 is a roller member which is provided face-to-face with the photoreceptor drum 12 through the opening 2*a* formed in the developer tank 2 so as to face the photoreceptor drum 12 and of which axis line is parallel to an axis line of the photoreceptor drum 12. The developing roller 3 is rotatably supported in the developer tank 2 and rotated by a driving section (not shown) in an arrow 13 direction. The developing roller 3 carries on a surface thereof a toner layer which is conveyed by the rotation in the arrow 13 direction to a development region formed on a most adjacent portion between the developing roller 3 and the photoreceptor drum 12, thereby supplying the toner to an electrostatic latent image on a surface of the photoreceptor drum 12.

The supply roller 4 is a roller member which is provided at a position facing the photoreceptor drum 12 via the developing roller 3 so as to abut against the developing roller 3 and which is supported in the developer tank 2 so as to be rotatable in an arrow 14 direction. The rotation of the supply roller 4 causes the toner contained in the developer tank 2 to be supplied to a surrounding area of the developing roller 3, whereby the toner layer is formed on the surface of the developing roller 3.

The stirring member 5 is a screw-shaped roller member which is provided at a position facing the developing roller 3 via the supply roller 4 so as to be spaced away from the supply roller 4 and which is rotatably supported in the developer tank 2. The stirring member 5 stirs the toner which is supplied from the toner hopper (not shown) to the developer tank 2 in accordance with a consumption degree of the toner therein, thus bringing the toner to an even state, and conveys the toner to a surrounding area of the supply roller 4.

The doctor blade 6 is a thin plate member which is provided so that one end in a transverse direction is supported in the developer tank 2 while the other end acts as a free end portion and comes into contact with the surface of the developing roller 3. A tip of the other end, i.e., the free end portion, is formed into a hook shape which is bent in an outward direction from the surface of the developing roller 3. For the doctor blade 6, it is possible to use a thin plate formed of an elastic material, for example. The selection of the elastic material is not limited to a particular ingredient. The elastic material includes, for example, an elastic metal and elastic synthetic resin. The doctor blade 6 adjusts a thickness of the toner layer carried on the surface of the developing roller 3 to a desired value.

The cleaning member 7 is a thin plate member which has its one end extending in parallel with the axis line of the developing roller 3 inside the developer tank 2 and acting as an free end portion that can be attached to and detached from a contact portion of the doctor blade 6 with the developing roller 3 and its adjacent portion of the doctor blade 6 and which has the other end inserted into the through hole 2*b* formed in an exterior wall on the upper part of the developer tank 2 and extending upwardly in the vertical direction of the developer tank 2 to be coupled to the later-described driving mechanism 9. The cleaning member 7 is supported by the later-described supporting section 8 so as to extend downwardly in the vertical direction from a connection with the driving mechanism 9 and then be inserted into the through hole 2*b*. The cleaning member 7 is further supported, inside the developer tank 2, so as to have its free end portion and an adjacent portion thereof bent from the vertical direction toward the doctor blade 6 by means of supporting rollers 8*a* and 8*b* of the supporting section 8. Moreover, a tip of the free end portion is formed into a hook shape which is bent upwardly in a circumferential direction of the developing roller 3 or in the vertical direction. A thickness of the hook-shaped portion may be smaller than a thickness of the other portions. When the tip of the free end portion is formed into the hook shape, the free end portion of the cleaning member 7 can move into the contact portion between the developing roller 3 and the doctor blade 6 upon sliding to rub the contact portion of the doctor blade 6 with the developing roller 3 and its adjacent portion of the doctor blade 6, thus allowing removal of even the toner coagulated product adhered to a downstream surface of the doctor blade 6 in the rotational direction of the developing roller 3. Further, the cleaning member 7 may have a slit (not shown) which is a through hole in a thickness direction, in order not to impede the flow of the toner mainly inside the developer tank 2. A shape, the number, and other elements of the slit are not particularly limited, and may be selected as appropriate from a range of not causing decrease in mechanical strength and thus service life of the cleaning member 7. The cleaning member 7 is formed of a material which exhibits elasticity in form of thin plate and which can be bent by external force. Usable materials include elastic metal materials such as aluminum and stainless steel. Moreover, the usable materials are not limited to the elastic metal materials, and a resin sheet is also usable. Examples of the resin sheet include a resin sheet formed of synthetic resin such as fluorine resin, polyethylene terephthalate, polybutylene terephthalate, and polyimide. Even commercially-available products may be used, including Teflon sheet, Mylar sheet, and Kapton sheet (which are all trade names). When used, the resin sheet can be divided in a longitudinal direction of the developer tank 2 into plural pieces. A thickness of the cleaning member 7 is not limited to a particular level, and a preferable thickness is about 0.2 mm to 2 mm.

The cleaning member 7 is driven by the rotation of the later-described driving mechanism 9 to undergo reciprocal linear movement such as to move between a contact position where its free end portion contacts the doctor blade 6 and a distant position where its free end portion is away from the doctor blade 6. The cleaning member 7 may be constantly at the contact position but preferably controlled to be at the distant position according to need. This allows extension of service life of each the cleaning member 7, and the supporting section 8 and driving mechanism 9 which are attached to the cleaning member 7, and furthermore the doctor blade 6. The cleaning member 7 is at the contact position, for example, in the following cases: the case where the image forming apparatus provided with the developing device 1 terminates one image forming operation, and an interval of time exists until a start of next image forming operation; the case where an image forming operation is carried out continuously for a long stretch of time; the case where the doctor blade 6 is designed to be cleaned at constant intervals regardless of whether an image forming operation continues or is terminated; and the case where a power source is turned on after an OFF state, and an interval of time exists between the input of power source and a start of first image forming operation. That is to say, it is preferred that the cleaning member 7 be usually at the distant position and in the above-stated cases, controlled to move to the contact position.

The movement of the cleaning member 7 relative to the doctor blade 6 is controlled by a control unit 36 (refer to FIG. 7) including a central processing unit (CPU) which controls entire operations of the image forming apparatus provided with the developing device 1. The control unit 36 includes a memory portion, a computing portion, and a control portion. It is preferred that upon control conducted by the control unit 36, a position sensor (not shown) be simultaneously used which detects a position of the cleaning member 7 between the contact position and the distant position relative to the doctor blade. For the position sensor, an optical sensor or the like can be used. One example of the control conducted by the control unit 36 is as follows. A result of detection conducted by the position sensor is inputted to the memory portion of the control unit 36 to which timing of the cleaning member 7 to contact the doctor blade 6 has been further inputted in advance. Specific examples of the contact timing include: a time point when the memory portion completes transmission of a control signal for image forming operation; a time point when a certain length of time has passed since a previous contact time; a time point when a certain number of sheets has been obtained or a certain length of time has passed in the image forming operation which continues for a certain length of time or longer; and a time point when the power source of the image forming apparatus is turned on. The computing portion takes data of the contact timing from the memory portion. When the computing portion determines that the present time corresponds to the contact timing, the control portion transmits, in accordance with a result of determination conducted by the computing portion, a control signal to the power source (not shown) which supplies driving electricity to a driving source (not shown) for rotating a rotary driving section 10 of the driving mechanism 9. The rotary driving section 10 is thus rotated in an arrow 15 direction so that the cleaning member 7 is made to move to the contact position where the free end portion of the cleaning member 7 comes into contact with the doctor blade 6. When the cleaning member 7 is located at the contact position, it is necessary to clean the doctor blade 6 by performing a rubbing operation of sliding the free end portion of the cleaning member 7 back and forth on the doctor blade 6 so as to rub the doctor blade 6. Accordingly, the control portion transmits a control signal to narrow a width of rotation of the rotary driving section 10 after the position sensor or the like confirms that the free end portion has come into contact with the doctor blade 6, thereby controlling the free end portion in contact with the doctor blade 6 to repeatedly slide on and thus rub the surface of the doctor blade 6. Data of the contact time of the cleaning member 7 with the doctor blade 6, which is set according to the contact period, has been previously inputted to the memory portion. After the set contact time has passed, the control portion transmits a control signal to a power source of the rotary driving section 10 to rotate a rotary driving section 10 in a direction opposite to an the arrow 15 direction so that the cleaning member 7 is made to move away from the doctor blade 6 to the distant position. After that, upon coming of next contact timing, the moving operation and the rubbing operation to the contact position are carried out as in the case of the above. The cleaning member 7 undergoes the reciprocal linear movement repeatedly between the contact position and the distant position. When the cleaning member 7 is located at the contact position, the free end portion slides on and thus rubs a contact portion of the doctor blade 6 with the developing roller 3 and its adjacent portion of the doctor blade 6 to remove the toner coagulated product adhered thereto.

The supporting section 8 includes supporting rollers 8*a*, 8*b*, 8*c*, and 8*d*, and supports the cleaning member 7 so as to be movable in an arrow 17 direction. The supporting rollers 8*a*, 8*b*, 8*c*, and 8*d* are each composed of a pair of roller members which are in pressure-contact with each other and each of which is supported so as to rotate about its shaft center. The cleaning member 7 is sandwiched between the respective pairs of the roller members at pressure-contact portions of the supporting rollers 8*a*, 8*b*, 8*c*, and 8*d*, which thus support the cleaning member 7. The supporting roller 8*a* supports vicinity of the free end portion of the cleaning member 7 in the case where the cleaning member 7 is located at the distant position. The supporting roller 8*b* supports vicinity of a point where the cleaning member 7 starts to curve. In other words, a part supported by the supporting roller 8*b* is a starting point of the curve formed in the cleaning member 7. The supporting roller 8*c* is disposed in the vicinity of a lower part in a vertical direction of the through hole 2*b* formed in the developer tank wall of the developer tank 2. In cooperation with the supporting roller 8*d* which is disposed outside above the developer tank 2 and in the vicinity of an upper part in the vertical direction of the through hole 2*b*, the supporting roller 8*c* makes the cleaning member 7 undergo smooth reciprocal movement inside the through hole 2*b*. The positions and numbers of the supporting rollers 8*a*, 8*b*, 8*c*, and 8*d* being installed are not limited to those as shown in FIG. 1 and FIG. 2 and may be appropriately changed according to design information such as a diameter of the developing roller 3, a spaced distance between the developing roller 3 or supply roller 4 and the stirring member 5, a shape of the doctor blade 6, the contact position of the doctor blade 6 with the developing roller 3, a position where the through hole 2*b* is formed, and an outer size of the developer tank 2. The supporting section 8 makes the cleaning member 7 be partially curved so that the free end portion of the cleaning member 7 comes into contact with the doctor blade 6, and moreover makes the cleaning member 7 stably undergo the reciprocal linear movement.

The driving mechanism 9 includes the rotary driving section 10 and a drive transmitting member 11. The rotary driving section 10 is supported by a driving source (not shown) so as to be rotatable and disposed at one end portion in a direction parallel to the axial direction of the developing roller 3. The rotary driving section 10 is rotated. As described above, the rotary drive of the rotary driving section 10 is controlled by the control unit 36 provided in the image forming apparatus in which the developing device 1 is provided. For the rotary driving section 10, it is possible to use, for example, a motor which is rotatable in both of forward and backward directions. The drive transmitting member 11 is a rod-shaped member which extends from a face of the rotary driving section 10 facing the developer tank 2 to an upper part in the vertical direction of the developer tank 2 in parallel with the axial line of the developing roller 3 and reaches the other end portion in the direction parallel to the axial line of the developing roller 3. To the drive transmitting member 11 is coupled the cleaning member 7 of which longitudinal direction is equal to or longer than that of the doctor blade 6. The drive transmitting member 11 converts the rotary movement caused by the rotary driving section 10 into the reciprocal linear movement, and transmits the reciprocal linear movement to the cleaning member 7.

In the developing device 1, the rotation of the stirring member 5 and the supply roller 4 leads the toner to be carried by the surface of the developing roller 3 to thereby form a toner layer thereon inside the developer tank 2. As a layer thickness of the toner layer on the surface of the developing roller 3 is controlled by the doctor blade 6 and, according to need, the cleaning member 7 is brought into contact with the doctor blade 6 to thereby remove the toner coagulated product adhered thereto, the toner is supplied from the toner layer to an electrostatic latent image on the surface of the photoreceptor drum 12 so that a toner image is formed.

Figure 3:
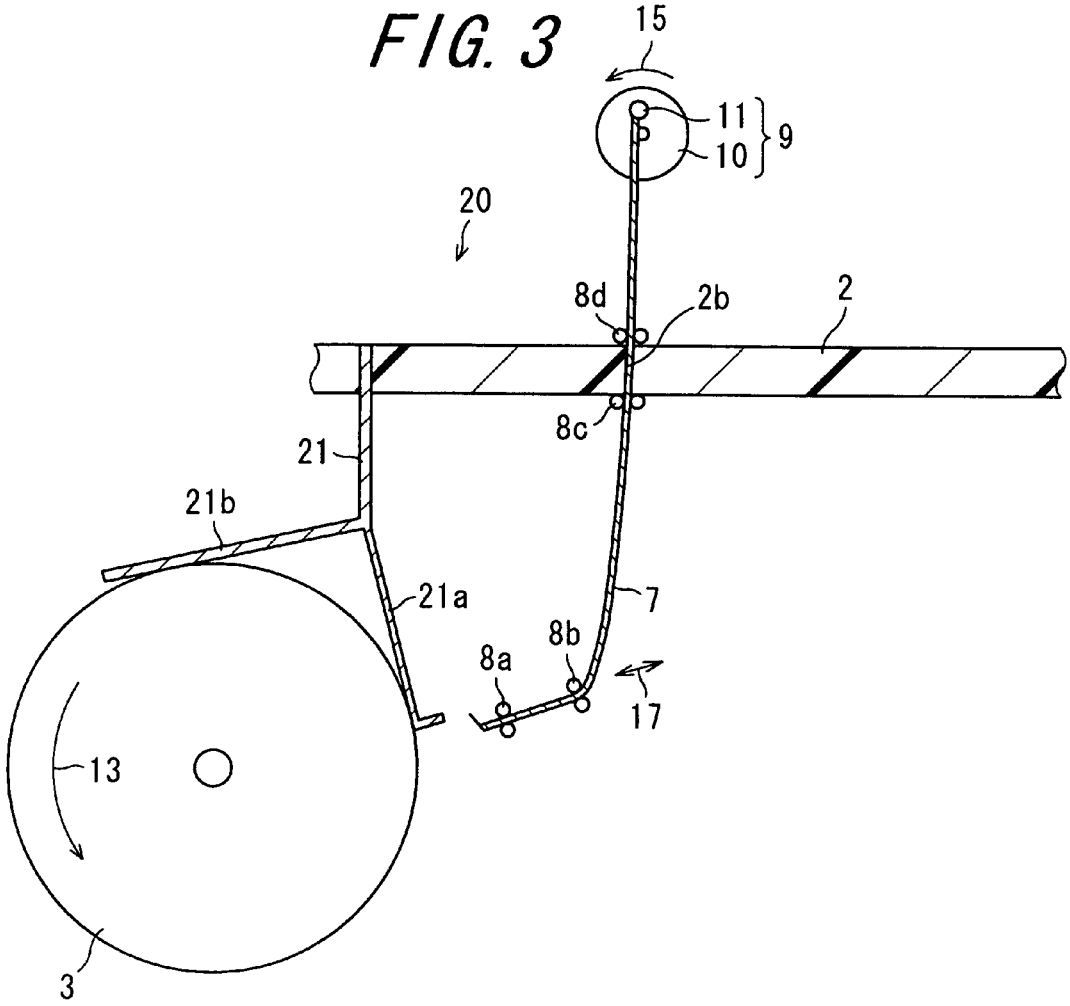
FIG. 3 is a sectional view schematically showing a configuration of chief part of a developing device according to a second embodiment.

FIG. 3 is a sectional view schematically showing a configuration of chief part of a developing device 20 according to a second embodiment. The developing device 20 is similar to the developing device 1, and corresponding parts will be denoted by the same reference numerals to omit descriptions thereof, or alternatively, illustrations of the corresponding parts will be omitted. The developing device 20 is characterized by a doctor blade 21 with which the doctor blade 6 in the developing device 1 is replaced. The doctor blade 21 is an elongated platy member which extends in parallel with the axial line of the developing roller 3 and of which sectional shape is formed into an inverted Y shape in a direction perpendicular to the axial direction of the developing roller 3. That is to say, the doctor blade 21 is formed of thin plates made of an elastic metal material such as stainless steel, and formed in such a manner that two elongated rectangular thin plates are bonded to each other only at its peripheral part on one long side of each of the thin plates, which part is now referred to as a bonded part, and the bonded part extends from one long side to the vicinity of an end point where the bonded part ends in a direction from the one long side to the other long side, and two non-bonded thin plates are respectively bent outwardly in opposite directions of the facing thin plates, resulting in a doctor blade 21*a* and a doctor blade 21*b*. The doctor blade 21 comes into contact with the developing roller 3 at two contact positions. This is very effective for equalization of the toner layer carried on the developing roller 3. Also in the developing device 20, the removal of the toner coagulated product adhered to the contact portion of the doctor blade 21*a* with the developing roller 3 by use of the cleaning member 7 is effective to prevent the image defects such as white stripes from arising so that high-quality images are formed for a long period of time.

Figure 4:
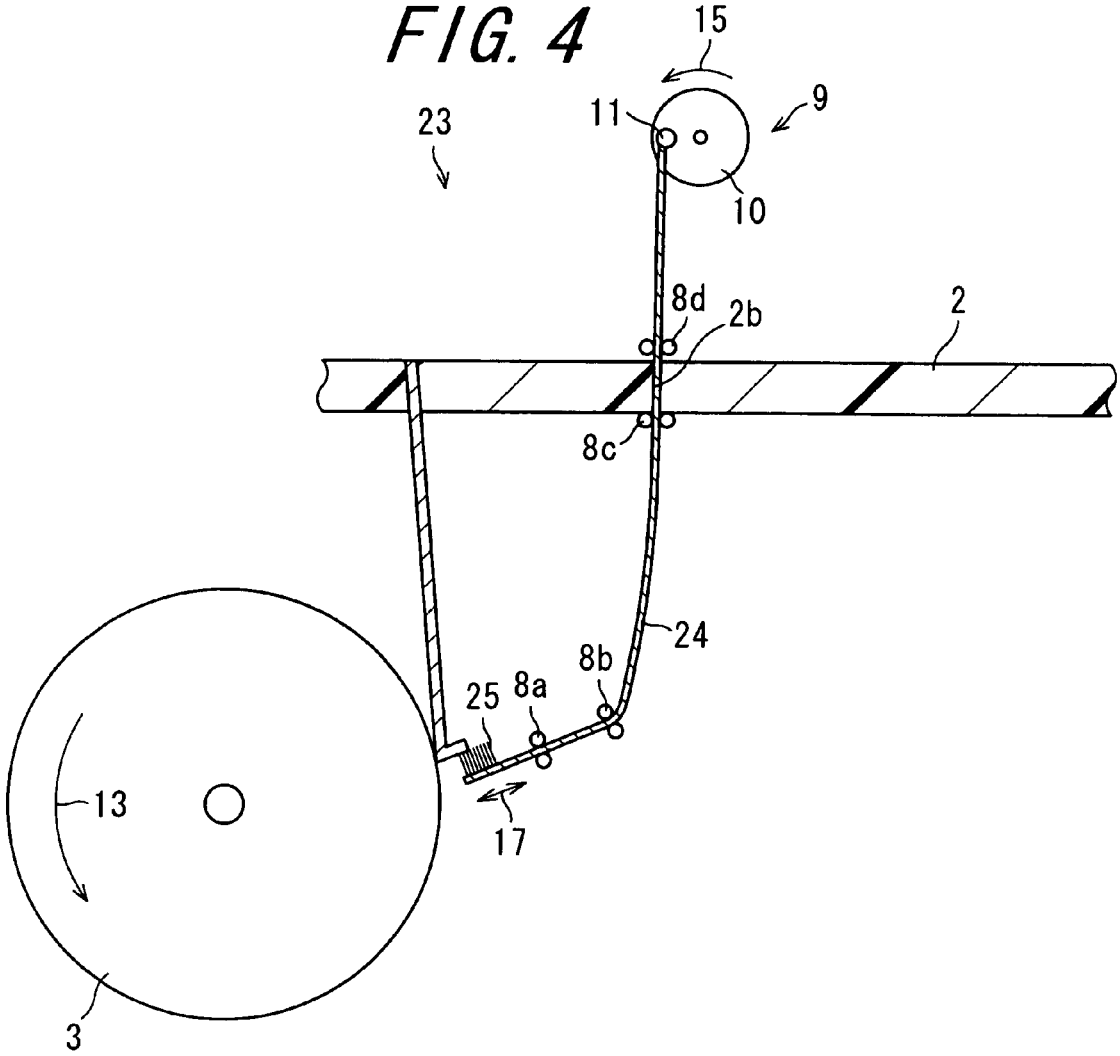
FIG. 4 is a sectional view schematically showing a configuration of chief part of a developing device according to a third embodiment.

FIG. 4 is a sectional view schematically showing a configuration of chief part of a developing device 23 according to a third embodiment. The developing device 23 is similar to the developing device 1, and corresponding parts will be denoted by the same reference numerals to omit descriptions thereof, or alternatively, illustrations of the corresponding parts will be omitted. The developing device 23 is characterized by a cleaning member 24 with which the cleaning member 7 in the developing device 1 is replaced. The cleaning member 24 is characterized in its free end portion, i.e., a tip 25 which is formed into a brush shape. It is possible to implant brush bristles directly in the tip 25. The brush bristles are formed into a stripe shape, a columnar shape, etc., and implanted as in the case of a commonly-available brush bristles, including in a radial pattern or in a linear pattern composed of plural arrays. Further, a brush-shaped member may be coupled to the tip 25. In any case, preferably used are brush bristles which exhibit conductivity of around $1.0\times10^{6}$ Ω·cm to $1.0\times10^{10}$ Ω·cm in electrical resistance value, including those manufactured by blending conductive materials such as carbon black in synthetic resin such as polyamide and then forming the resultant compound into a fiber shape, a pile shape, or the like shape. A diameter of a brush bristle is not limited to a particular level, and a preferable diameter is around 150 to 400 denier. In the case of using the cleaning member 24 having the brush-shaped tip 25, the brush part slides to rub the contact portion of the doctor blade 6 with the developing roller 3 and its adjacent portion of the doctor blade 6, thus leading further enhancement in efficiency of removing the toner coagulated product. As a result, the image defects such as white stripes caused by the fused toner adhered to the doctor blade 6 can be further prevented from arising.

Figure 5:
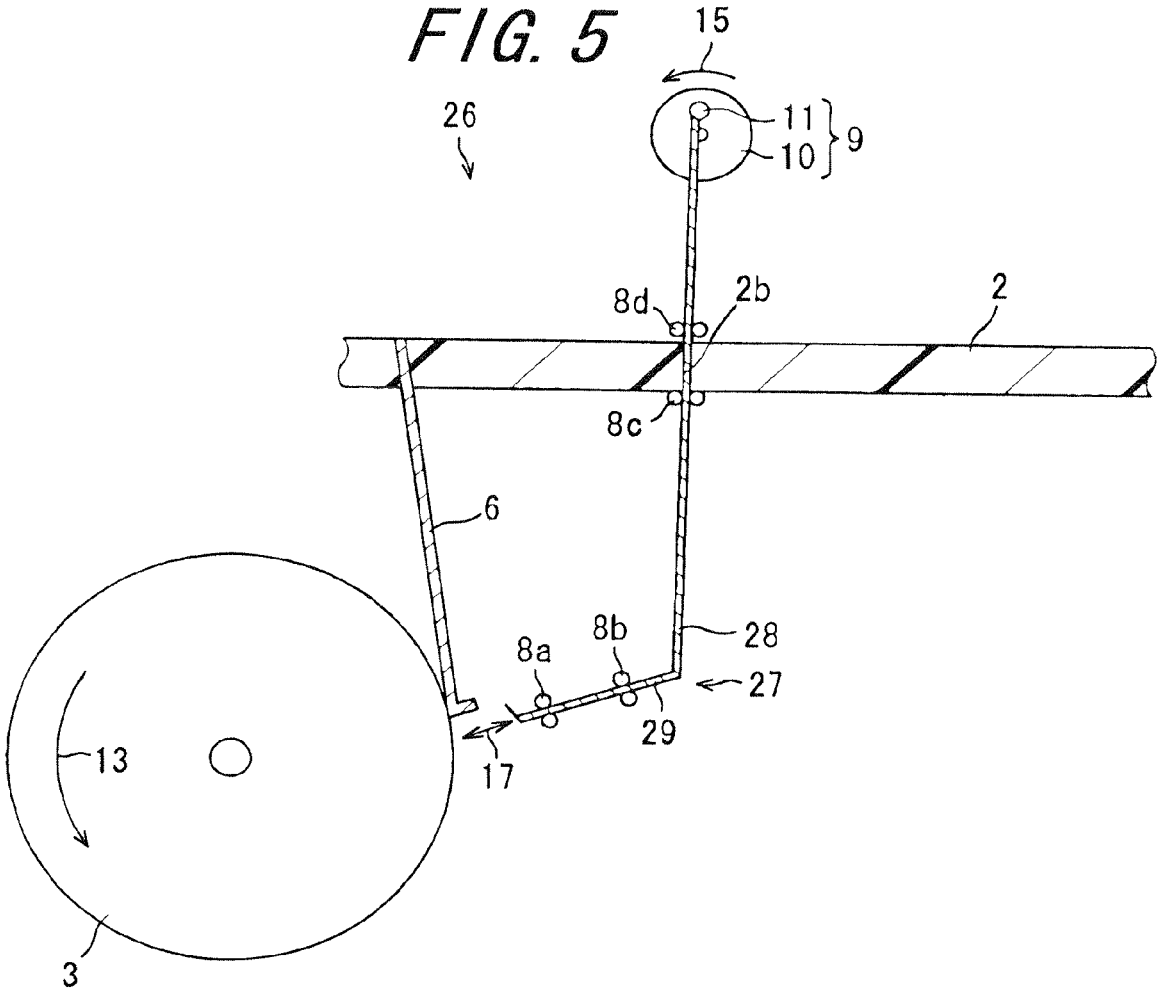
FIG. 5 is a sectional view schematically showing a configuration of chief part of a developing device according to a fourth embodiment.
Figure 6:
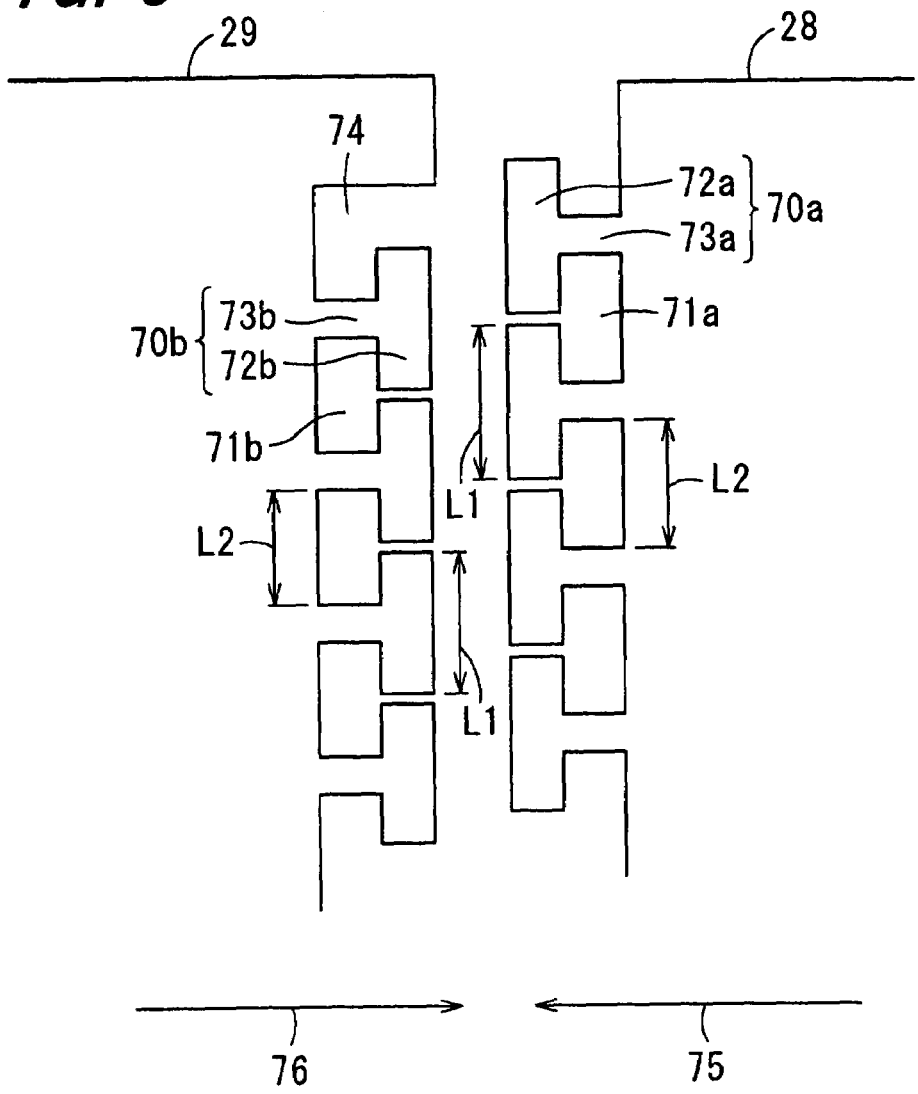
FIG. 6 is a top view showing a configuration of chief part of a cleaning member used in the developing device shown in FIG. 5.

FIG. 5 is a sectional view schematically showing a configuration of chief part of a developing device 26 according to a fourth embodiment. FIG. 6 is a top view showing a configuration of chief part of a cleaning member 27 used in the developing device 26 shown in FIG. 5. The developing device 26 is similar to the developing device 1, and corresponding parts will be denoted by the same reference numerals to omit descriptions thereof, or alternatively, illustrations of the corresponding parts will be omitted. The developing device 26 is characterized by a cleaning member 27 with which the cleaning member 7 in the developing device 1 is replaced. The cleaning member 27 includes a first platy member 28 and a second platy member 29. The first cleaning member 28 is inserted from the internal space of the developer tank 2 into the through hole 2*b* formed in the developer tank wall located at an upper part in the vertical direction of the developer tank 2, and extends upwardly in the vertical direction of the developer tank 2. One end of the first platy member 28, which is an end portion (side end portion) extending outside the developer tank 2 in parallel with the axial line of the developing roller 3 is connected to the driving mechanism 9 while the other end of the first platy member 28, which is an end portion (side end portion) extending inside the developer tank 2 in parallel with the axial line of the developing roller 3 is coupled to the second platy member 29. The first platy member 28 is supported also by the supporting rollers 8*c* and 8*d*. In the end portion of the first platy member 28 coupled to the second platy member 29 are alternately formed a plurality of fitting pieces 70*a* and fitting grooves 71*a* in a direction parallel to the axial line of the developing roller 3. In other words, the fitting groove 71*a* is formed between the adjacent fitting pieces 70*a*. The fitting piece 70*a* is composed of a coupling portion 73*a* and a fitting portion 72*a*. The coupling portion 73*a* extends in a direction perpendicular to the axial line of the developing roller 3 from the end portion of the first platy member 28 facing the second platy member 29. The fitting portion 72*a* is formed continuously from the coupling portion 73*a* and has a rectangular shape. A length of the fitting portion 72*a* in a direction parallel to the axial line of the developing roller 3 is L1. Further, a length of the fitting groove 71*a* in a direction parallel to the axial line of the developing roller 3 is L2. The fitting pieces 70*a* and the fitting groove 71*a* are preferably formed so that L1>L2 is satisfied. The second platy member 29 extends in the internal space of the developer tank 2 toward the doctor blade 6 and is provided so as to be detachable from the contact portion of the doctor blade 6 with the developing roller 3 and its adjacent portion of the doctor blade 6. An end portion (side end portion) of the second platy member 29 facing the doctor blade 6 is a free end portion which is attached to and detached from the doctor blade 6. An end portion (side end portion) of the second platy member 29 which is positioned on the opposite side to the end portion facing the doctor blade 6 and extends in parallel with the axial line of the developing roller 3, is coupled to the end portion (side end portion) of the first platy member 28 extending inside the developer tank 2 in parallel with the axial line of the developing roller 3. The second platy member 29 is supported also by the supporting rollers 8*a* and 8*b*. In the end portion of the second platy member 29 coupled to the first platy member 28 are alternately formed a plurality of fitting pieces 70*b* and fitting grooves 71*b* in a direction parallel to the axial line of the developing roller 3. In this case, the fitting groove 71*b* is formed at a position corresponding to the fitting piece 70*a* in the first platy member 28 while the fitting piece 70*b* is formed at a position corresponding to the fitting groove 71*b* in the first platy member 28. The fitting piece 70*b* is composed of a coupling portion 73*b* and a fitting portion 72*b* . The coupling portion 73*b* extends in a direction perpendicular to the axial line of the developing roller 3 from the end portion of the second platy member 29 facing the first platy member 28. The fitting portion 72*b* is formed continuously from the coupling portion 73*b* and has a rectangular shape. A length of the fitting portion 72*b* in a direction parallel to the axial line of the developing roller 3 is L1. Further, a length of the fitting groove 71*b* in a direction parallel to the axial line of the developing roller 3 is L2. The fitting pieces 70*b* and the fitting groove 71*b* are preferably formed so that L1>L2 is satisfied. In an end portion of the second platy member 29 in a direction perpendicular to the axial line of the developing roller 3 is formed a fitting groove 74 of which shape is different from that of the fitting groove 71*b*. The fitting grooves 74 are formed only in both end portions of the second platy member 29 in a direction perpendicular to the axial line of the developing roller 3 so that the first platy member 28 and the second platy member 29 are uncoupled from each other. The first platy member 28 is made to move in an arrow 75 direction while the second platy member 29 is made to move in an arrow 76 direction so that the fitting piece 70*a* and the fitting groove 71*b* are fit to each other while the fitting piece 70*b* and the fitting groove 71*a* are fit to each other, resulting in a hook configuration. The first platy member 28 and the second platy member 29 are thus coupled to each other. In the developing device 26, the reciprocal linear movement is transmitted from the driving mechanism 9 to the second platy member 29 via the first platy member 28 to thereby subjecting the second platy member 29 to reciprocal linear movement in an arrow 17 direction so that the free end portion of the second platy member 29 is attached to and detached from the doctor blade 6.

Figure 7:
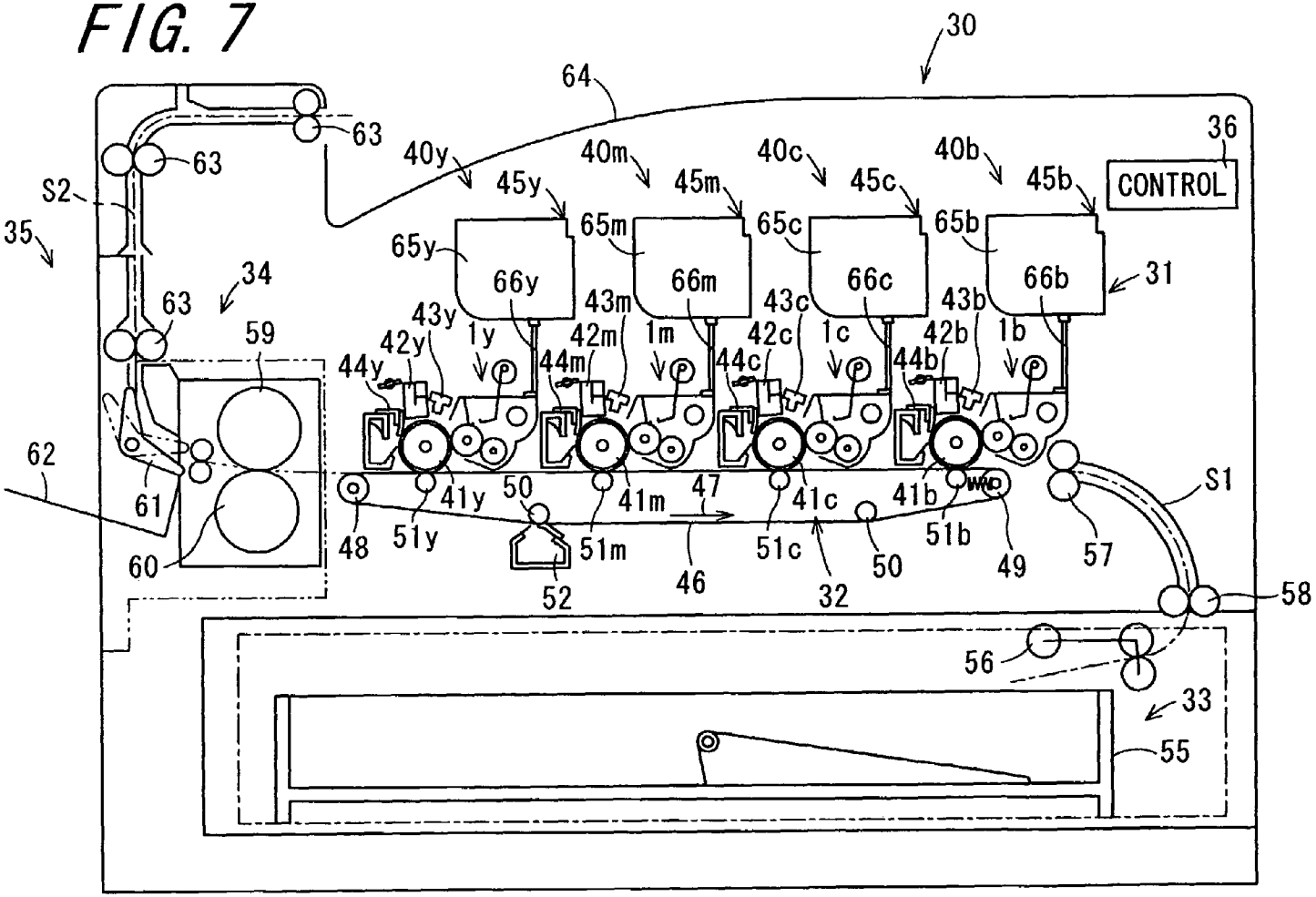
FIG. 7 is a sectional view schematically showing a configuration of an image forming apparatus according to another embodiment.

FIG. 7 is a sectional view schematically showing a configuration of an image forming apparatus 30 according to another embodiment. The image forming apparatus 30 is an electrophotographic full-color printer provided with the developing device 1 according to the first embodiment of the invention. The image forming apparatus 30 forms a full-color or black-and-white image on a recording medium such as recording paper, in accordance with image information which has been created by an external apparatus such as a personal computer and then transmitted to the image forming apparatus 30.

The image forming apparatus 30 is a full-color printer in which the image information corresponds to a color image using respective colors of black (b), cyan (c), magenta (m), and yellow (y). Accordingly, for the respective colors, there are provided four sets of image forming units 40 contained in a toner image forming section 31 and four sets of respective members constituting the image forming unit 40. Herein, alphabets "b", "c", "m" and "y" indicating the respective colors are added to ends of reference numerals attached to the four sets of respective parts for the respective colors, which are thus distinguished. These parts are collectively indicated by reference numerals only. The image forming apparatus includes the toner image forming section 31, a transfer section 32, a recording medium supply section 33, a fixing section 34, and a discharging section 35.

The toner image forming section 31 includes the image forming unit 40. The image forming unit 40 includes a photoreceptor drum 41, a charger 42, an exposing unit 43, the developing device 1, a cleaning unit 44, and a toner supply section 45. Among these components, the charger 42, the exposing unit 43, the developing device 1, and the cleaning unit 33 are disposed in this order around the photoreceptor drum 41. The charger 42 is a charging section for charging a surface of the photoreceptor drum 41 evenly to a predetermined potential. Any charger of a charger type, a roller type, a brush type, or the like type may be used as the charger 42. As the exposing unit 43, a laser scanning unit having a laser emitting portion and a reflecting mirror is used, for example. In accordance with the image information, the exposing unit 43 exposes the surface of the photoreceptor drum 41 charged to a uniform potential, to thereby form an electrostatic latent image on the surface of the photoreceptor drum 41. The developing device 1 supplies the toner to the electrostatic latent image formed on the surface of the photoreceptor drum 41, thus conducting development to thereby form a toner image which is a visible image. The cleaning unit 44 removes from the surface of the photoreceptor drum 41 a residual toner which has failed to be transferred from the surface of the photoreceptor drum 41 onto the recording medium, and then collects the residual toner. The toner supply section 45 includes a toner hopper 65 and a toner conveying pipe 66. The toner hopper 65 is a toner storage container, and usually formed into a cartridge system. The toner conveying pipe 66 is a pipe-shaped member which communicates an internal space of the toner hopper 65 with an internal space of the developing device 1, and supplies the toner contained in the toner hopper 65 to the developing device 1. In the toner image forming section 31, the electrostatic latent image is formed on the surface of the photoreceptor drum 41, and the toner is supplied from the developing device 1 to the electrostatic latent image for development so that the toner image is formed on the surface of the photoreceptor drum 41.

The transfer section 32 includes a transfer belt 46, a driving roller 48, a tension roller 49, a transfer belt driven roller 50, a transfer roller 51 (*y, m, c, b*), and a transfer belt cleaning unit 52. The transfer belt 46 is stretched over the driving roller 48, the tension roller 49, and the transfer belt driven roller 50, to be thereby rotated in an arrow 47 direction by rotation of the driving roller 48. The transfer belt 46 is provided so as to contact each photoreceptor drum 41, and conveys a recording medium which is fed by a later-described recording medium supply section 33. When the recording medium conveyed by the transfer belt 46 passes between the transfer belt 46 and the photoreceptor drum 41, a toner image on the surface of the photoreceptor drum 41 is transferred onto the recording medium. In the case of forming a full-color image, toner images of the respective colors on the surfaces of the respective photoreceptor drums 41 are sequentially deposited and thus transferred onto the recording medium. A full-color image is thus formed. The transfer roller 51 is disposed so as to face the photoreceptor drum 41 with the transfer belt 46 lying therebetween. The transfer roller 51 is subjected to a transfer bias of which polarity is opposite to polarity of the charged toner. The transfer bias causes the toner image on the surface of the photoreceptor drum 41 to be transferred onto the recording medium. The transfer belt cleaning unit 52 is provided so as to be in contact with an outer circumference of the transfer belt 46. The toner adhered to the transfer belt 46 upon contacting the photoreceptor drum 41 causes smears on a back side of the recording medium. The transfer belt cleaning unit 52 therefore removes and then collects the toner from the surface of the transfer belt 46. In the transfer section 32, the toner image on the surface of the photoreceptor drum 41 is transferred onto the recording medium which is placed on and thus conveyed by the transfer belt 46.

The recording medium supply section 33 includes a paper feed tray 55, a pickup roller 56, registration rollers 57, and conveying rollers 58. The paper feed tray 55 is provided in a lower part in a vertical direction of the image forming apparatus 30, and stores the recording medium. The recording medium includes, for example, recording paper such as regular paper, paper exclusively used for color-image formation, and coated paper, and OHP (overhead projector) sheets. The pickup roller 56 takes out sheet by sheet the recording medium stored in the paper feed tray 55, and feeds the taken-out recording medium to a sheet conveyance path S1. The conveying rollers 58 further feed the recording medium fed by the pickup roller 56 toward the registration rollers 57. The registration rollers 57 are provided ahead of the transfer section 32 in a conveyance direction. The registration rollers 57 nip therebetween the recording medium which is then retained once, and feed the recording medium toward the transfer belt 46 of the transfer section 32 by synchronizing timing, in response to a detection output from a pre-registration detecting sensor (not shown), so that a tip of the toner image formed on the surface of the photoreceptor drum 41 is registered to a tip of an image-formed region on the recording medium. By use of the recording medium supply section 33, the recording medium stored in the paper feed tray 55 is fed sheet by sheet onto the transfer belt 46 upon timing of the toner image formation.

The fixing section 34 is provided on a downstream side of the transfer belt 46 in the conveyance direction of the recording medium, and includes a heating roller 59, a pressure roller 60, a heating source (not shown) of the heating roller 59, a sensor (not shown) for detecting a surface temperature of the heating roller 59, and a control portion for controlling an operation of the heating source so as to set the temperature of the heating roller 59 to a predetermined level. The heating roller 59 and the pressure roller 60 are provided so that the recording medium can be nipped and thus conveyed by the heating roller 59 and the pressure roller 60 which are pressed against each other. In the fixing section 34, when the recording medium passes through a nip portion formed between the heating roller 59 and the pressure roller 60, the toner image is heated and pressurized to be thereby fixed onto the recording medium, thus resulting in a solid recording image.

The discharging section 35 includes a conveyance direction switching guide 61, a first catch tray 62, a sheet discharging roller 63, and a second catch tray 64. The conveyance direction switching guide 61 is provided on a downstream side of the fixing section 34 in the conveyance direction of the recording medium, and switches the conveyance direction of the recording medium on which the toner image is fixed by the fixing section 34. The recording medium is discharged onto the first catch tray 62 protruding outward on a side face of the image forming apparatus 30, or alternatively fed to a sheet conveyance path S2 formed by the sheet discharging roller 63. The recording medium fed to the sheet conveyance path S2 is discharged by the sheet discharging roller 63 to the second catch tray 64 provided on an upper face of the image forming apparatus 30. The discharging section 35 discharges to the first catch tray 62 or the second catch tray 64 the recording medium on which the toner image is formed.

The image forming apparatus 30 is provided with a control unit 36. The control unit 36 is disposed, for example, in an upper part in an internal space of the image forming apparatus 30, and includes a processing circuit realized by a microcomputer or the like element having a central processing unit (CPU) and including a control portion, a computing portion, and a memory portion. To the memory portion of the control unit 36 are inputted an image forming command transmitted by way of an operation panel (not shown) disposed on the upper face of the image forming upparatus 30, a detection result obtained from a sensor (not shown) or like component disposed in various parts inside the image forming apparatus 30, image information obtained from an external equipment, and the like element. on the basis of the inputted various data (the image forming command,the detection result, the image information, or the like element), a determination is conducted by the computed portion. In accordance with the determined result, the control portion transmits a control signal to therby control an entire operation of the image forming apparatus 30. As the memery portion, components commonly used in this field are available, including a read only memery (ROM), a random access memory (RAM), and a hard disk drive (HDD). As the external equipment, it is possible to use an electrical/electronic equipment which can form or obtain image information and which can be electrically connected to the image forming apparatus, including a computer, a digital camera, a television, a video recorder, a DVD recorder, and a facsimile apparatus. The control unit 36 includes a power source as well as the above-mentioned processing circuit. The power source supplies electricity to not only the control unit 36 but also various devices inside the image forming apparatus 30. In the case of using the image forming apparatus 30, the toner image formed on the photoreceptor drum 41 by the toner image forming section 31 is transferred onto the recording medium which has been fed from the recording medium supply section 33 to the surface of outer circumference of the transfer belt 46 of the transfer section 32 and then conveyed by the transfer belt 46, wherby the recording medium carries the toner image, and the recording medium carring the toner image is conveyed to the fixing section 34 to be subject to the heat and pressure so that the toner image is fixed onto the recording medium, followed by being discharged by the discharging section 35 from inside of the image forming apparatus 30 to the first catch tray 62 or the second catch tray 64, resulting in completion of a seriesof the image forming operation.

In the image forming apparatus of the described embodiments, applicable materials, layer structures, sizes, and the like elements of the intermediate transfer belt, transfer belt, respective rollers, and other components are those common in the electrophotographic image forming field, which are used as they are or in appropriately modified states. Further, the roller may be replaced by an endless member such as a belt. Furthermore, the intermediate transfer belt and the conveying belt are defined as endless belts, but may be in form of rollers. Moreover, although the image forming apparatus is described in form of a color-image forming apparatus of tandem system in each of the embodiments, the image forming apparatus is not limited to those as described and may be formed into, for example, a so-called four-round color-image forming apparatus where an image of one color is deposited for every one rotation of the intermediate transfer belt. In addition, the image forming apparatus is not limited to the color-image forming apparatus and may be formed into a single-color image forming apparatus. The image forming apparatus is used as a complex machine composed of two or more of a copier, a printer, and a facsimile, for example.

Various aspects of the disclosure may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing device provided in an electrophotographic image forming apparatus, comprising:

a developer tank having an internal space for containing a toner;

a developing roller for carrying a toner layer on a surface thereof and supplying a toner to an electrostatic latent image on a photoreceptor drum;

a doctor blade in contact with a surface of the developing roller, for regulating a layer thickness of the toner layer on the surface; and a cleaning member composed of a platy member, the cleaning member being disposed so that one end of the cleaning member extends in parallel with an axis line of the developing roller and makes angular contact with a contact portion of the doctor blade with the developing roller and its adjacent portion of the doctor blade while another end of the cleaning member is inserted into a through hole formed in a developer tank wall of the developer tank and extends to outside of the developer tank, wherein the cleaning member is curved at a portion between both ends of the cleaning member.

2. The developing device of claim 1, wherein the developer tank wall is in a vertical direction of the developer tank, a through hole is formed in an upper part of the developer tank wall, and the other end of the cleaning member is inserted into the through hole and extends upwardly in the vertical direction of the developer tank.

3. The developing device of claim 1, further comprising:

a supporting section having at least a part provided inside the developer tank, which supports the cleaning member so as to be detachable from the contact portion of the doctor blade with the developing roller and its adjacent portion of the doctor blade; and a driving mechanism which moves the cleaning member to be attached to and detached from the contact portion and its adjacent portion of the doctor blade.

4. The developing device of claim 3, wherein the driving mechanism comprises:

a rotary driving section which rotates; and a drive transmitting section having one end coupled to the rotary driving section and another end coupled to the cleaning member, which converts a rotary drive caused by the rotary driving section into a reciprocal linear drive and transmits the reciprocal linear drive to the cleaning member, wherein the cleaning member is driven by the reciprocal linear drive transmitted from the drive transmitting section to be attached to and detached from the contact portion and the adjacent portion of the doctor blade.

5. The developing device of claim 3, wherein the supporting section is arranged to support the cleaning member such that the one end making the angular contact with the doctor blade reciprocally moves in a direction parallel to an outward direction from the surface of the developing roller.

6. The developing device of claim 1, wherein a tip of the cleaning member in contact with the doctor blade is formed into a hook shape which is bent in a rotational direction of circumference of the developing roller.

7. The developing device of claim 1, wherein at least a tip of the cleaning member in contact with the doctor blade is brush-shaped.

8. The developing device of claim 7, wherein an electrical resistance of the brush-shaped portion in contact with the doctor blade substantially ranges between $1.0\times10^{6}$ Ω·cm to $1.0\times10^{10}$ Ω·cm.

9. The developing device of claim 1, wherein the cleaning member is of a resin sheet.

10. The developing device of claim 9, wherein the resin sheet is divided into plural pieces in a longitudinal direction of the developer tank.

11. The developing device of claim 1, wherein the cleaning member comprises:

a first platy member which is inserted into the through hole formed in the developer tank wall and extends to outside of the developer tank; and a second platy member which extends toward the doctor blade inside the developer tank and is detachable from the doctor blade, wherein a side end portion of the first platy member extending in parallel with an axis line of the developing roller inside the developer tank is coupled to a side end portion of the second platy member which extends in parallel with the axis line of the developing roller and is located on an opposite side of a side end portion of the second platy member facing the doctor blade.

12. The developing device of claim 1, wherein a tip of the doctor blade in contact with the surface of the developing roller is formed into a hook shape which is bent in an outward direction from the contact portion with the developing roller.

13. The developing device of claim 12, wherein the cleaning member makes contact with a surface of the doctor blade that extends in an outward direction from the surface of the developing roller.

14. An electrophotographic image forming apparatus, comprising:

a photoreceptor drum;

a charging section;

an exposing section;

a developing section;

a transfer section; and a fixing section, wherein the developing section includes the developing device of claim 1.

15. The electrophotographic image forming apparatus of claim 14, further comprising a control unit arranged to control a position of the cleaning member relative to the doctor blade.

16. The electrophotographic image forming apparatus of claim 15, wherein the control unit is arranged to control a contact timing in which the cleaning member makes contact with the doctor blade.

17. The electrophotographic image forming apparatus of claim 16, wherein the contact timing includes one or more of:

a time point when a predetermined contact time amount has passed since a previous contact time, a time point when a predetermined number of sheets has been obtained, a time point when a predetermined amount of processing time has passed since a beginning of an image forming operation, and a time point when a predetermined amount of on time has passed since when the image forming apparatus was turned on.

18. The developing device of claim 1, wherein the cleaning member is arranged to remove toner adhered to a downstream surface of the doctor blade in a rotational direction of the developing roller.

19. The developing device of claim 1, wherein the cleaning member is arranged to be at a contact position contacting the doctor blade when any one or more of the following conditions are true:

when a predetermined operation interval amount of time has passed since a termination of one image forming operation and before a start of a next image forming operation, when an image forming operation is carried out continuously for a predetermined continuous operation amount of time, when a predetermined blade clean interval amount of time has passed since a last doctor blade cleaning operation, and when a predetermined of input power interval amount of time has passed since an input power has been detected prior to starting an image forming operation.

* * * * *